US005125323A

United States Patent [19]

Yonezawa

[11] Patent Number: 5,125,323

[45] Date of Patent: Jun. 30, 1992

[54] PRESSURIZED OIL SUPPLY/DISCHARGE CIRCUIT AND VALVE DEVICE FOR USE IN SUCH CIRCUIT

[75] Inventor: Keitaro Yonezawa, Kobe, Japan

[73] Assignee: Kabushiki Kaisha Kosmek, Hyogo, Japan

[21] Appl. No.: 725,616

[22] Filed: Jul. 3, 1991

[30] Foreign Application Priority Data

Jul. 13, 1990 [JP] Japan ..... 2-186470

[51] Int. Cl.[5] ..... F15B 13/02

[52] U.S. Cl. ..... 91/447; 91/451; 137/493.3; 137/493.6; 137/493.9; 137/599.2

[58] Field of Search ..... 91/445, 447, 451; 137/493.3, 493.6, 493.9, 599, 599.2

[56] References Cited

FOREIGN PATENT DOCUMENTS 54-108156 8/1979 Japan .
1-240242 9/1989 Japan .

*Primary Examiner*—Gerald A. Michalsky
*Attorney, Agent, or Firm*—Bacon & Thomas

[57] ABSTRACT

A check valve (14) with a valve opening actuator and a bypass passage (16) are disposed in parallel in a pressurized oil supply/discharge passage (3) connected in communication with a hydraulic actuation chamber (2). A residual pressure holding valve (17) and a flow restrictor (21) are disposed in series in the bypass passage (16). The supply/discharge passage (3) and a discharge passage (7) are connected in communication by a pressure compensation valve (12). While the valve (17) is adapted to be moved to a valve closing position by means of pressure supplied at a check valve inlet (14*a*) and a residual pressure holding spring (19), it is adapted to be moved to its valve opening position by means of pressure supplied at a check valve outlet (14*b*). The valve (17) includes a valve member (38) resiliently urged to a valve seat (40) by means of a spring (19).

7 Claims, 13 Drawing Sheets

PRESSURIZED OIL SUPPLY/DISCHARGE CIRCUIT AND VALVE DEVICE FOR USE IN SUCH CIRCUIT

BACKGROUND OF THE INVENTION

1. Field of the Invention

The present invention relates to a pressure or pressurized oil supply/discharge circuit with a residual pressure holding function and a residual pressure holding valve device for use in the pressurized oil supply/discharge circuit, which are adapted to maintain a predetermined pressure within a hydraulic actuation chamber even in the event that a breakage of a hydraulic hose and the like causes on oil leak in a pressurized oil supply/discharge passage connected to the hydraulic actuation chamber of a hydraulic cylinder.

2. Description of the Prior Art

A known pressure oil supply/discharge circuit with a residual pressure holding function has been disclosed in Japanese Patent Laid Open Publication No. 1979-108156.

As shown in the circuit diagram of FIG. 21, this publication discloses a hydraulic cylinder applied to a clamping device.

That is, a clamping hydraulic actuation chamber 403 is disposed on one side of a piston 402 of a double-acting type hydraulic cylinder 401, a check valve 405 with a forcibly valve-opening (actuator) function is disposed in a clamping pressure oil supply/discharge passage 404 connected to the hydraulic actuation chamber 403, and an unclamping pressure oil supply/discharge passage 407 is connected to an unclamping actuation chamber 406 formed on the other side of the piston 402.

At the time of clamping, oil is discharged from the unclamping hydraulic actuation chamber 406 and the clamping pressure oil is supplied to the clamping hydraulic actuation chamber 403, so that the hydraulic cylinder 401 is operatively contracted to press and fix a fixed object 410 by means of a clamping member 409. Under this clamping condition, when a pressure on the inlet side of the check valve 405 abnormally lowers due to a breakage of a hydraulic hose and the like, the check valve 405 serves to prevent a counter flow so as to leave or maintain a pressure remaining within the clamping hydraulic actuation chamber 403 and thus to prevent a shift and/or a fall of the fixed object 410. Incidentally, slight leakage of pressure from the check valve 405 is adapted to be supplemented by means of an accumulator 411.

On one hand, at the time of unclamping, when the pressurized oil is supplied from the unclamping pressure oil supply/discharge passage 407 to the unclamping hydraulic actuation chamber 406, the check valve 405 is opened by means of hydraulic pressure via a pilot oil passage 413, so that pressurized oil is allowed to be discharged from the clamping hydraulic actuation chamber 403 and the hydraulic cylinder 401 is operatively extended.

The above-mentioned prior art has the advantage that the clamping condition can be held by means of a one-way checking function of the check valve 405 even though a pressure oil leakage is caused on the inlet side of the check valve 405, but there is the following problem associated therewith.

For example, like in a hydraulic clamping device for a metal mould of an injection moulding machine, when the hydraulic cylinder is subjected to a raised temperature under the clamping condition, pressure within the clamping hydraulic actuation chamber 403 gradually increases due to a cubical (volumetric) expansion of the pressurized oil. Thereby, the clamping force of the hydraulic cylinder 401 may increase sufficiently to give concern over damage to a fixed object 410.

SUMMARY OF THE INVENTION

It is an object of the present invention to make maintenance of a pressure within a hydraulic actuation chamber by means of a check valve compatible with the prevention of excessive pressure increase or built up within the hydraulic actuation chamber.

For accomplishing the above object, the pressurized oil supply/discharge circuit is improved as follows.

For example, as shown in FIGS. 2 through 4, a bypass passage 16 is connected to a pressure (i.e. pressurized) oil supply/discharge passage 3 in parallel with a check valve 14. A relief type residual pressure holding valve 17 and a flow resistance application means (restrictor) 21 are disposed in series in the bypass passage 16. A valve opening operation of the residual pressure holding valve 17 is adapted to be carried out by a differential force between pressure at a check valve outlet **14*b* and a resultant force of a pressure at a check valve inlet 14*a* and the resilient force of a residual pressure holding spring 19. A pressure compensation valve 12 is disposed in the pressurized oil supply/discharge passage 3 and the pressurized oil discharge passage 7 in parallel with the pressurized oil supply/discharge changeover means 4. The pressure compensation valve 12 is adapted to discharge only a very slowly increased portion of the hydraulic pressure within the hydraulic actuation chamber 2**.

This circuit operates as follows.

Under a normal pressure condition in which a pressure at the check valve inlet **14*a* is within a first pressure range $R_1$, when the pressures of the hydraulic actuation chamber 2 and of the check valve outlet 14*b* increase or build up slowly due to the volumetric expansion of the pressurized oil caused by heat reception at the hydraulic cylinder 1, the residual pressure holding valve 17 is opened by that increased hydraulic pressure so that the aforementioned increased portion of the hydraulic pressure can be released to the pressurized oil discharge passage 7 through the valve 17, the pressurized oil supply/discharge passage 3 and the pressure compensation valve 12 in that order. At as a result, the pressure in the hydraulic actuation chamber 2** can be prevented from being excessively increased.

Further, under the normal pressure condition in which the pressure of the check valve inlet **14*a* is within the first pressure range $R_1$, also when the pressure on the side of the check valve inlet 14*a* abnormally lowers due to an abrupt oil leakage caused by a breakage of a hydraulic hose 10 and a little oil leakage from pipings, similarly to the aforementioned case, since the received pressure from the check valve outlet 14*b* overcomes a resultant force of the received pressure from the check valve inlet 14*a* and the spring force of the residual pressure holding spring 19 to open the residual pressure holding valve 17, the pressurized oil within the hydraulic actuation chamber 2 can be discharged slowly to the pressure port P through the valve 17 and the flow restrictor means 21. But, when the pressure on the side of the check valve outlet 14*b* has lowered to the second pressure range $R_2$, the spring 19 serves to close the valve 17 so as to prevent a further lowering of the pressure and to maintain the pressure of the chamber 2** within the second pressure range $R_2$.

Therefore, according to the first invention, it is possible to make maintaining a pressure remaining within the hydraulic actuation chamber at the time of abnormal lowering of the check valve inlet side pressure compatible with a prevention of an excessive pressure increase within the hydraulic actuation chamber.

Incidentally, in the aforementioned construction, in case the resilient force of the residual pressure holding spring is set at a smaller value than the received pressure of the residual pressure holding valve, which is received from the check valve outlet side when the pressure of the check valve outlet side (the pressure of the working port) has reached a working set pressure H, since the pressure of the hydraulic actuation chamber of the hydraulic cylinder can be provided with at least two kinds of pressure ranges such as the first pressure range $R_1$ and the second pressure range $R_2$, the following advantages can be provided. When the hydraulic cylinder is used as a hydraulic clamp for a metal mould of an injection moulding machine and as a hydraulic clamp for a metal mould of a press machine, since the clamp can be changed over to a high pressure clamping condition after completion of a fitting of moulds under a low pressure clamping condition, the mould fitting becomes easy. Further, when the hydraulic cylinder is used as a hydraulic clamp for a cutting machine workpiece, since it becomes possible to finish the work under the low pressure clamping condition after completion of a powerful rough machining under the high pressure clamping condition, the machining time can be shortened and machining accuracy can be improved. Further, by making the resilient force of the residual pressure holding spring as small as possible, the difference between an upper limit and a lower limit of the first pressure range $R_1$ becomes small and a variable range of the pressure of the working port A can be small.

A residual pressure holding valve device for use in the pressure oil supply/discharge circuit of the aforementioned first invention is constructed as follows.

For example, as shown in FIGS. 1 and 7, a bypass passage 16 is disposed in a portion that extends from the pressure port P to said working port A, in parallel with the check valve seat 28 and the check valve chamber 29 within a valve casing 27. A residual pressure holding valve 17 and flow restrictor means 21 having a throttling passage 44 are disposed in series in the bypass passage 16. The valve 17 is of the relief type and comprises a residual pressure holding valve member 38 resiliently urged for valve closing to a residual pressure holding valve seat 40 by means of a residual pressure holding spring 19. The resilient force of said residual pressure holding spring 19 is set at a smaller value than the fluid force which the valve member 38 receives from the check valve outlet **14*b* when the pressure of the working port A has reached a working set pressure H. A valve opening operation of the valve member 38 is adapted to be performed by means of a differential force between a received pressure of the check valve outlet 14*b* and a resultant force of a received pressure of said check valve inlet 14*a* and a a resilient force of the residual pressure holding spring 19**.

This valve device operates as follows.

When the pressure of the pressure port P has lowered to the second pressure range $R_2$ from the first pressure range $R_1$, the residual pressure holding valve member 38 is brought into contact with the residual pressure holding valve seat 40 for valve closing by the resilient force of the residual pressure holding spring 19. Therefore, the residual pressure holding valve 17 can be made simple in construction by omission of an opening/closing operation device. Further, by setting the resilient force of the spring 19 at a small value, the spring can be made small in size, the valve device 11 can be made small in size, and a valve-closing contact force between the valve member 38 and the valve seat 40 can be made small to prolong their sealing service times. In case the spring 19 is retained by a valve-opening hydraulic piston 33 and the resilient force thereof is set at a smaller value than the resilient force of a checking spring 31, a spring retaining construction can be simple and relief accuracy can be improved.

The pressurized oil supply/discharge circuit having the above-mentioned conventional construction is improved by this invention as follows.

As shown in FIGS. 13 and 14, a valve opening actuator means 115 has its hydraulic actuation chamber adapted to be selectively connected to a valve-opening pressurized oil supply passage 184 and to a valve-operating cancellation oil discharge passage 185 through a pressurized oil supply/discharge passage 182 and a pressurized oil supply/discharge changeover means 183. A check valve outlet **114*b* and the pressure oil supply/discharge passage 182 of the valve opening actuator means 115 are connected to each other by means of a relief passage 116, and a flow restrictor means 121 and a residual pressure holding valve 117 of the relief type are disposed in the relief passage 116. The valve opening operation of the residual pressure holding valve 117 is performed by the differential force between a received pressure at the check valve outlet 114*b* and the resilient force of a residual pressure holding spring 119**.

This circuit operates as follows.

Under the normal pressure condition in which the pressure of the check valve inlet **114*a* is within a first pressure range $R_1$, when the pressures of the hydraulic actuation chamber 102 and of the check valve outlet 114*b* increase very slowly due to the volumetric expansion of the actuating oil caused by the heat reception or absorption of the hydraulic cylinder 101, the residual pressure holding valve 117 is opened by that slowly increased hydraulic pressure so that the pressure oil the check valve outlet 114*b* can be released to the valve-opening cancellation pressure oil discharge passage 185 through the flow restrictor means 121, the valve 117, the pressurized oil supply/discharge passage 182 and the pressurized oil supply/discharge changeover means 183 in order. As a result, the pressure in the hydraulic actuation chamber 102 can be prevented from being abnormally built up or increased. Further, under normal pressure conditions in which the pressure of the check valve inlet 114*a* is within the first pressure range $R_1$, when the pressure on the side of the check valve inlet 114*a* abnormally lowers due to an abrupt oil leakage caused by a breakage of a hydraulic hose 110 and possibly a little oil leakage from conduits, the resilient force of the residual pressure holding spring 119 overcomes the received pressure from the check valve outlet 114*b* to hold the residual pressure holding valve 117 in the valve closed condition. Thereby, the pressure in the hydraulic actuation chamber 102** can be held within the first pressure range $R_1$. Accordingly, it is possible to maintain a pressure within the hydraulic actuation chamber at the time of abnormal lowering of the check valve inlet side pressure compatible with a prevention of build up of excessive pressure increase within the hydraulic actuation chamber.

The residual pressure holding valve device for use in the pressurized oil supply/discharge circuit of the above-mentioned third invention is constructed as follows.

For example, as shown in FIG. 12, a valve opening actuator means 115 of the hydraulic actuation type is adapted so that a valve-opening hydraulic piston 133 adapted to be fitted oil-tightly and movably into a check valve member 130 can be actuated towards the valve opening side or direction by means of a hydraulic force applied from a pilot port F. The check valve outlet 114*b* and the pilot port F are connected to each other by means of the relief passage 116 formed in the piston 133. A flow resistance application means 121 having a throttling passage 144 and the residual pressure holding valve 117 are arranged in that order in the relief passage 116. The valve 117 is of the relief type and comprises a residual pressure holding valve member 138 resiliently urged for valve closing to a residual pressure holding valve seat 140 by means of the residual pressure holding spring 119. A valve opening operation of the piston valve member 138 is adapted to be performed by the differential force between a received pressure at the check valve outlet 114*b* and the resilient force of the spring 119.

This valve device operates as follows.

Since the residual pressure holding valve 117 and the flow resistance application means 121 are disposed in the relief passage 116 passing through the interiors of the check valve member 130 and of the valve-opening hydraulic piston 133, a casing dedicated for the valve 117 and means 121 can be omitted so that the valve device 111 can be made small and simple.

The residual pressure holding valve device is constructed as follows.

For example, as shown in FIGS. 16 through 18, a valve seat tube 239 is inserted oil-tightly and movably into a valve casing 227, and an insertion port 236 for a valve opening member 235, a check valve seat 228 and a check valve chamber 229 are disposed in series in the valve seat tube 239. The valve seat tube 239 is resiliently urged for valve closing to a check valve member 230 by means of a residual pressure holding spring 219. The check valve member 230 is resiliently urged for valve closing to the check valve seat 228 by means of a checking spring 231 and its valve closing movement beyond a predetermined distance is prevented by means of the valve opening member 235.

This valve device operates as follows.

Under such a condition that the pressure of the pressure port P is normal, when the pressure of the working port A increases very slowly due to the volumetric expansion of the trapped oil caused by the heat reception at the hydraulic cylinder, the valve seat tube 239 moves for valve opening and the valve closing movement of the check valve member 230 is transmitted to the valve opening member 235. The check valve 214 is thus opened, so that the aforementioned increased or excess portion of the hydraulic pressure is released from the pressure port P to the pressure oil discharge passage. As a result, the pressure of the hydraulic actuation chamber can be prevented from being excessively increased. When the pressure of the pressure port P abnormally lowers from the normal condition, similarly to the above case the check valve 214 is once opened by means of a differential pressure between its inlet and its outlet but it is closed by means of the residual pressure holding spring 219 when the pressure lowers to the set pressure. Thereby, the pressure of the pressure port P can be prevented from being abnormally lowered. Accordingly, it is possible to make maintenance of a pressure within the hydraulic actuation chamber upon abnormal lowering of the check valve inlet side pressure compatible with preventing excessive pressure increase or build up within the hydraulic actuation chamber.

BRIEF DESCRIPTION OF THE DRAWINGS

The above and other important features of the invention will be better understood from the following detailed descriptions of preferred embodiments and variants of the invention, made with reference to the accompanying drawings, in which:

FIGS. 1 through 7 show a first embodiment;

FIG. 1 is an enlarged sectional view taken along the I—I directed line in FIG. 5 and is a cross-sectional view of a residual pressure holding valve device;

FIG. 2 is a circuit diagram of a pressure oil supply/-discharge circuit;

FIG. 3 is a view showing a change of a pressure of a working port with respect to the lapse of time;

FIG. 4 is a circuit diagram of a hydraulic clamping device to which the present invention is applied;

FIG. 5 is a sectional view taken along the V—V directed line in FIG. 4;

FIG. 6 is a plan view of FIG. 5;

FIG. 7 is a schematic view of an operational explanation, FIG. 7(*a*) is a view showing a clamping condition, FIG. 7(*b*) is a view showing a residual pressure holding condition, and FIG. 7(*c*) is a view showing an unclamping condition;

FIG. 8 shows a variation of the embodiment shown in FIG. 1;

FIG. 9 shows another variation of the embodiment shown in FIG. 1;

FIG. 10 shows still another variation of the embodiment shown in FIG. 1;

FIG. 11 shows another variation of the FIG. 1 embodiment of the invention;

FIGS. 12 through 14 show a second embodiment;

FIG. 12 is a view of an alternate embodiment corresponding to FIG. 1;

FIG. 13 is a view of an alternate embodiment corresponding to FIG. 2;

FIG. 14 is a view of an alternate embodiment corresponding to FIG. 3;

FIG. 15 shows a variant of the second embodiment and is a view corresponding to FIG. 12;

FIGS. 16 through 18 show a third embodiment;

FIG. 16 is a view corresponding to FIG. 1;

FIG. 17 is a partial view corresponding to FIG. 2;

FIG. 18 is a view corresponding to FIG. 7;

FIG. 19 shows a fourth embodiment and is a partial view corresponding to FIG. 4;

FIG. 20 shows a fifth embodiment and is a partial view corresponding to FIG. 4.

DESCRIPTION OF THE PREFERRED EMBODIMENTS

Embodiment of the present invention will be explained with reference to the drawings hereinafter.

FIGS. 1 through 7 show a first embodiment.

Firstly, a construction of a pressure oil supply/discharge circuit with a residual pressure holding function and the operation thereof will be explained with reference to FIGS. 2 and 3.

Figure 2:
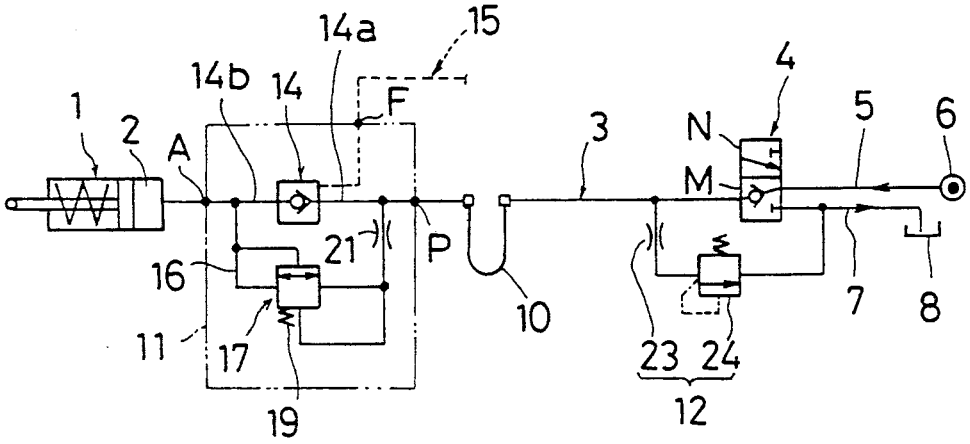
Figure 3:
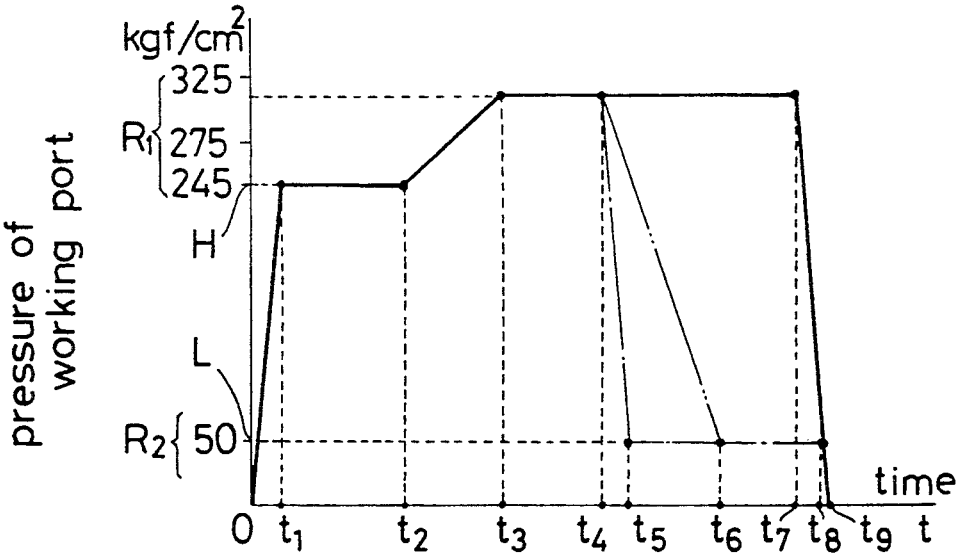

A circuit diagram of FIG. 2 shows a device for operatively extending and contracting a single-acting spring-returned type hydraulic cylinder 1.

A hydraulic actuation chamber 2 of a hydraulic cylinder 1 is adapted to be selectively connected to a hydraulic pressure source 6 at a starting end portion of a working pressure oil supply passage 5 and to an oil tank 8 at a terminal end portion of a return pressure oil discharge passage 7 through pressurized oil supply/discharge passage 3 and a pressurized oil supply/discharge changeover means 4. The changeover means 4 is composed of one changeover valve adapted to be changed over to a supply position M and to a discharge position N. A residual pressure holding valve device 11 is disposed between the hydraulic actuation chamber 2 and a hydraulic hose 10 of the pressurized oil supply/discharge passage 3. A pressure compensation valve 12 is arranged along the oil supply/discharge passage 3 and the oil discharge passage 7 in parallel with the supply/discharge changeover means 4.

The residual pressure holding valve device 11 is provided with a check valve 14 with a valve-opening actuator function, a valve opening means 15 of the hydraulic operation type, a bypass passage 16 connected to the check valve 14 in parallel, a residual pressure holding valve 17 and a flow resistance application means 21 both of which are disposed in series in the bypass passage 16. The valve member of the residual pressure holding valve 17 is adapted to be pushed towards its valve closed side by the resultant force (i.e., bias) of received pressure at a check valve inlet 14*a* and the resilient force of a residual pressure holding spring 19 and pushed to its valve opened side by received pressure at a check valve outlet 14*b*. The pressure compensation valve 12 comprises a throttling valve 23 and a relief valve 24 connected in series with each other.

At the time of extension of the hydraulic cylinder 1, the changeover means 4 is changed over to its supply position M as well and valve opening actuator means 15 is changed over to its pressure oil discharge position. Thereupon, pressurized oil from the hydraulic pressure source 6 flows into the hydraulic actuation chamber 2 through the pressure port P, the check valve inlet 14*a*, the outlet 14*b* and a working port A of the valve device 11 so as to operatively extend the hydraulic cylinder 1. The pressures of the hydraulic actuation chamber 2 and of the working port A increase as the extension resistance increases, and when it reaches a working set pressure H (herein, 245 Kgf/cm$^2$) within the first pressure range $R_1$ at substantially the same pressure as that of the hydraulic pressure source 6, the extension of the hydraulic cylinder 1 is completed (time $t_1$). In the midway course of increasing the pressure on the side of the check valve inlet 14*a*, the residual pressure holding valve 17 is held in the valve closed position by means of the residual pressure holding spring 19.

With the cylinder extension completed, if the hydraulic cylinder 1 receives external heat, the pressure of the hydraulic actuation chamber 2 starts to increase very slowly due to a volumetric expansion of the pressure oil (time $t_2$). When the pressure of the working port A increases to a pressure (herein, around 300~325 Kgf/cm$^2$) determined by both the resilient force of the residual pressure holding spring 19 of the residual pressure holding valve 17 and the spring force of the relief valve 24 (time $t_3$), the valve 17 serves to discharge only a very slowly increased portion of the hydraulic pressure from the oil discharge passage 7 to the oil tank 8 through the pressure compensating valve 12. Thereby, the pressures at the working port A and at the hydraulic actuation chamber 2 can be held within the first pressure range $R_1$.

While the cylinder is in its extended condition, when the pressure of the pressure port P starts to lower abnormally and rapidly due to a breakage of the hydraulic hose 10 and so on (time $t_4$), the pressure of the working port A lowers (refer to the figure indicated by the alternate long and short dash line) because the residual pressure holding valve 17 is opened by the received pressure of the check valve outlet 14*b* so as to allow the pressure oil to flow out of the working port A to the pressure port P while the check valve 14 serves to block a counter flow from the side of the outlet 14*b* to the side of the inlet 14*a*. When the pressure at the working port A lowers to the residual pressure set pressure (herein, 50 Kgf/cm$^2$) within the second pressure range $R_2$ (time $t_5$), the valve 17 is closed by the spring 19. Thereby, the pressures at the working port A and at the hydraulic actuation chamber 2 can be held within the second pressure range $R_2$. Further, in the case that the pressure of the pressure port P starts to abnormally lower very slowly due to a little leakage from the piping and the like at the time of $t_4$, the pressure at the working port A also lowers very slowly (refer to the figure indicated by the alternate long and two short dashes line). Thereupon, similarly to the aforementioned case, when the pressure of the working port A lowers to the aforementioned pressure within the second pressure range $R_2$ (time $t_6$), the valve 17 is closed so that the pressures of the port A and of the chamber 2 can be held within the second pressure range $R_2$.

On one hand, when the hydraulic actuation chamber 2 is held within the first pressure range $R_1$, when the hydraulic actuation chamber 2 is operatively contracted, the oil supply/discharge changeover means 4 is changed over to the discharge position N and valve opening actuator means 15 of the hydraulic operation type is changed over to the pressurized oil supply position (time $t_7$). Thereupon, the checking condition of the check valve 14 is cancelled so that the operating oil within the hydraulic actuation chamber 2 is discharged to the oil tank 8 through the working port A, the check valve outlet 14*b*, the check valve inlet 14*a*, the pressure port P and the changeover means 4 at the discharge position N, in that order. Accompanying therewith, the pressure of the hydraulic actuation chamber 2 drops rapidly, and then the contraction of the hydraulic cylinder 1 is completed (time $t_9$).

Incidentally, the contractional operation of the hydraulic cylinder 1 may be performed according to the following procedure. Under such a condition that the pressures of the hydraulic actuation chamber 2 and of the working port A are held within the first pressure range $R_1$, firstly only the changeover means 4 is changed over to the discharge position N at the time of $t_4$. Thereupon, the residual pressure holding valve 17 is opened and the pressurized oil within the hydraulic actuation chamber 2 is discharged therefrom so that the pressure of the hydraulic actuation chamber 2 drops to the second pressure range $R_2$ (time$_5$). Under this condition, the check valve 14 is opened by actuating the valve opening actuator means 15 to the pressure oil supply position (time $t_8$). Thereby, the pressure of the chamber 2 drops so that the contraction of the cylinder 1 is completed (time $t_9$).

The specific constructions of the aforementioned pressurized oil supply/discharge circuit and of the residual pressure holding valve device 11 will be explained with reference to FIGS. 4 through 7 and FIG. 1 hereinafter.

Figure 4:
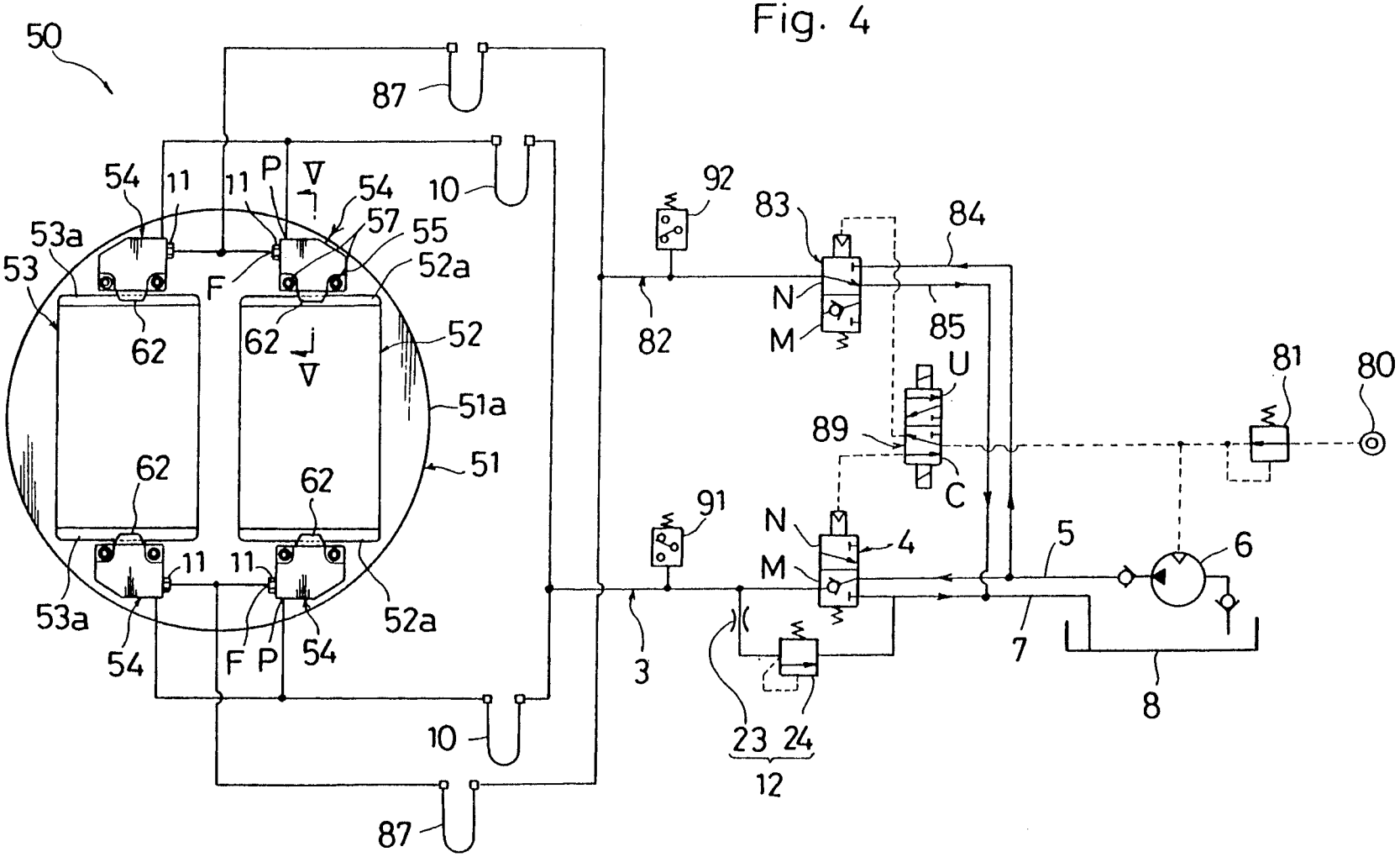

FIG. 4 shows a hydraulic clamp device 50 for fixing a metal mould to a rotary table type injection moulding machine.

A first metal mould 52 and a second metal mould 53 are fixedly secured to a circular rotary table frame 51 of the injection moulding machine by means of two hydraulic clamps 54, 54 respectively. Each hydraulic clamp 54 has its housing 55 whose opposite side walls are fixedly secured to the rotary table frame 51 by means of bolts 57, 57, and its clamping member 62 extended from the housing 55 is adapted to press upper and lower fixed portions 52*a*, 53*a* of each metal mould 52, 53.

In order to enable to be mounted within the outer peripheral surface 51*a* of the rotary table frame 51, the hydraulic clamps 54 are adapted to move the clamping member 62 forward and backward in an inclined direction with respect to the metal moulds 52, 53.

Figure 6:
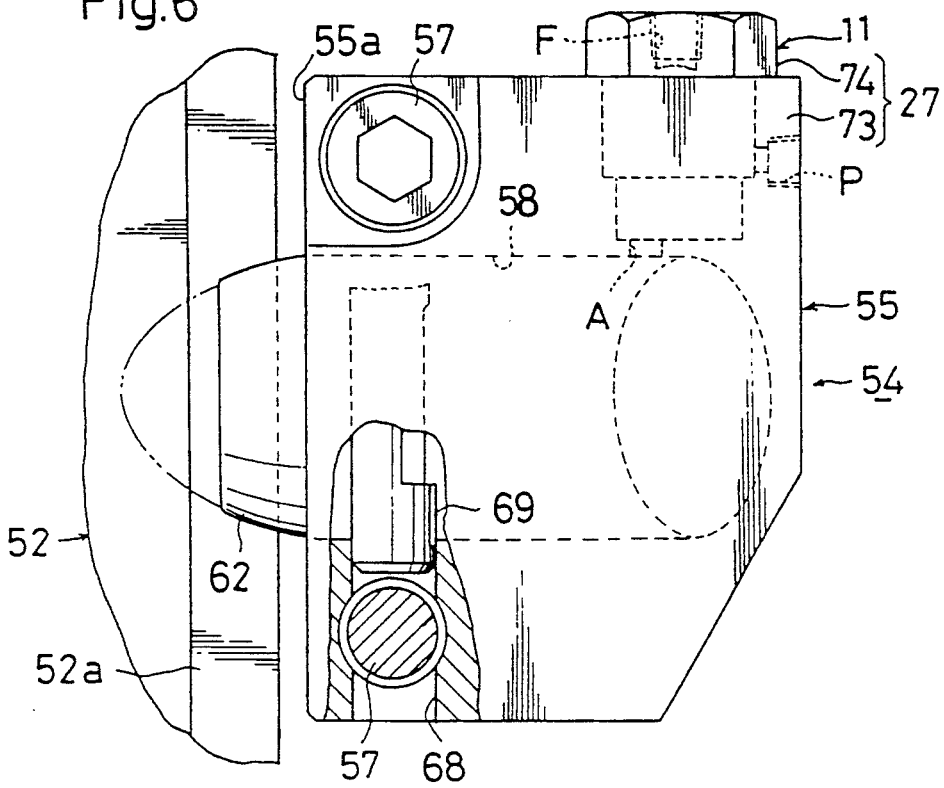
Figure 5:
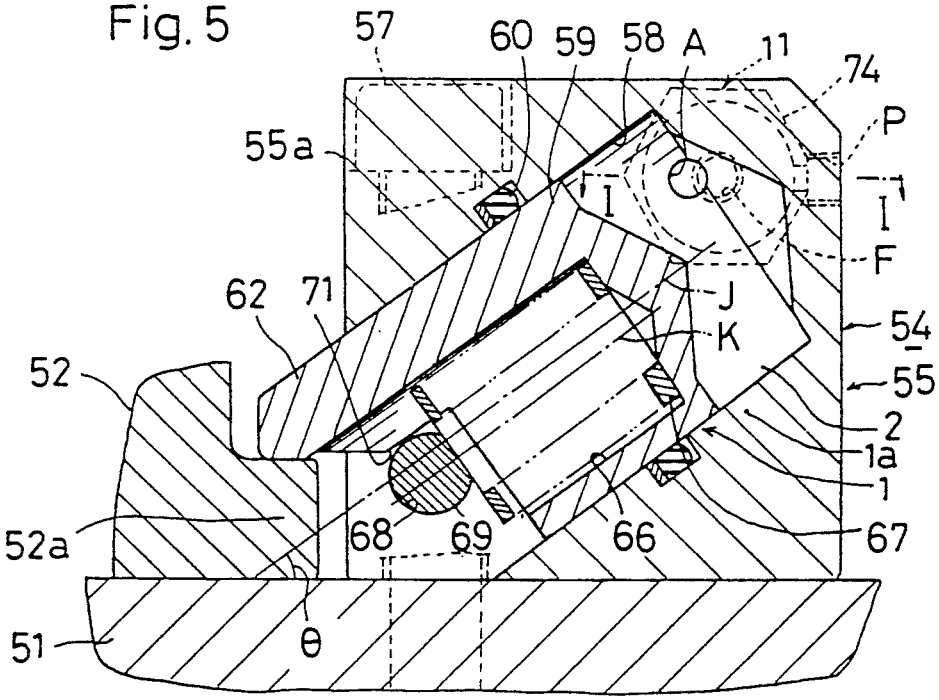

That is, as shown in a vertical sectional view of FIG. 5 and in a plan view of FIG. 6, a cylinder bore 58 of the hydraulic cylinder 1 is formed in the housing 55 of the hydraulic clamp 54 in a forwardly downwardly inclined manner. An inclination angle $\theta$ of the cylinder bore 58 is preferably defined at an angle of ab. 35 degree for making the housing 55 compact. A hydraulic piston 59 is inserted into the cylinder bore 58 through a packing 60 so as to be oil-tightly movable forwardly and backwardly. The hydraulic actuation chamber 2 is so formed in the cylinder bore 58 as to face the back surface of the piston 59. The clamping member 62 extends directly from the upper portion of the piston 59 toward its advancing side.

A spring accommodation bore 66 is formed in the piston 59 so as to extend backward from its front surface. The axis K of the bore 66 is displaced to a lower side below the axis J of the piston 59. An unclamping spring 67 composed of a compression spring is inserted into the bore 66. This spring 67 is mounted between the piston 59 and a spring retaining pin 69 put into a pin insertion hole 68 of the housing 55. A pair of left and right guide grooves 71, 71 are formed in the opposite lateral side portions in the front opened state in order to avoid an interference with the pin 69.

When the hydraulic clamp 54 is changed over to the clamping condition as illustrated, the pressurized oil is supplied to the hydraulic actuation chamber 2. Thereupon, the piston 59 is advanced by the hydraulic pressure, so that the clamping member 62 can be advanced to the clamping position beyond the front surface 55*a* of the housing 55. Thereby, the clamping member 62 serves to press and fix the fixed portions 52*a* of the metal mould 52 to the rotary table frame 51.

The residual pressure holding valve device 11 is arranged in the housing 55 of the aforementioned hydraulic clamp 54.

Figure 1:
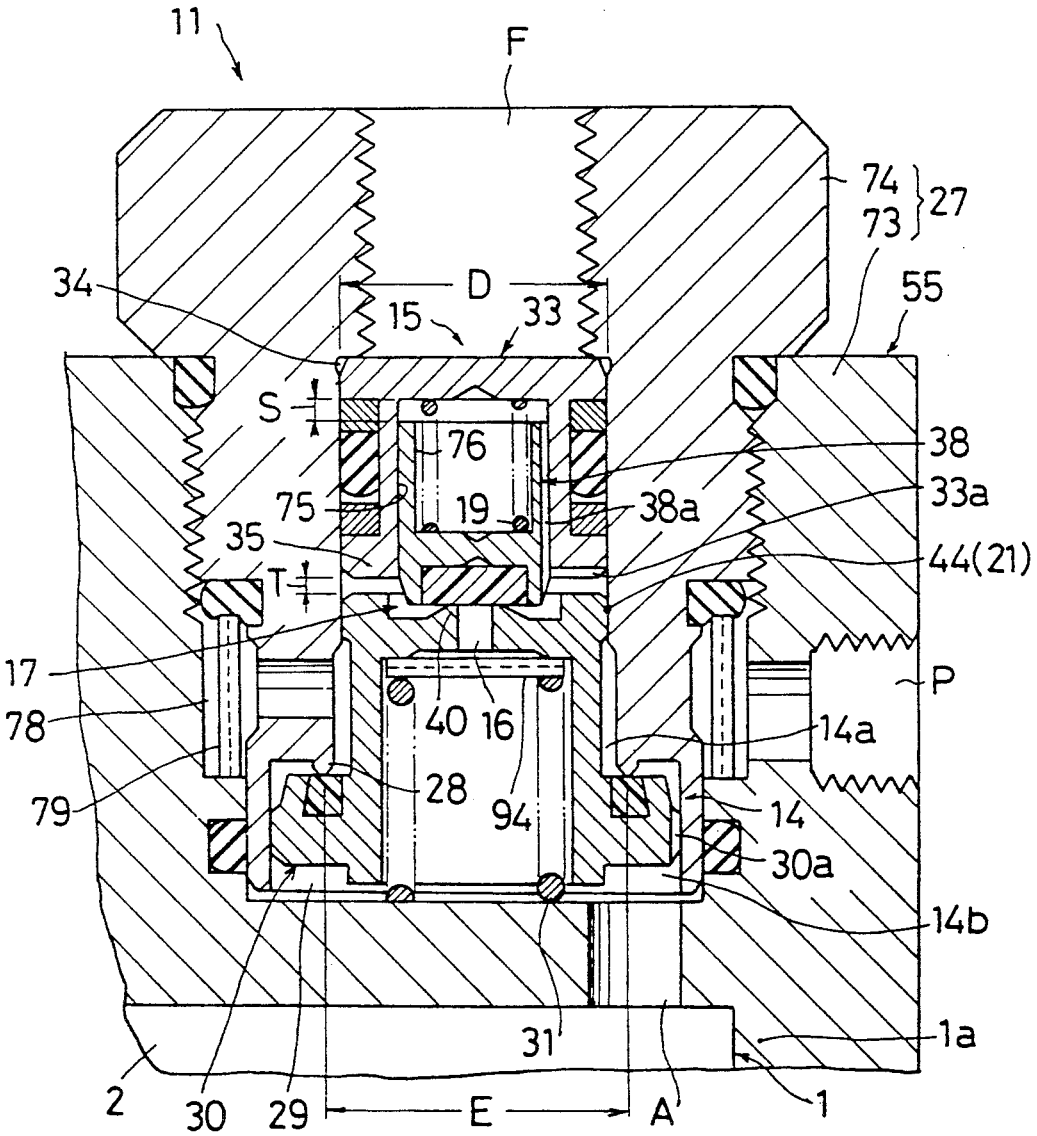
FIGS. 1 through 20 show embodiments of the present invention.

As shown in FIG. 1, the valve casing 27 of the valve device 11 comprises a wall portion 73 and a lid bolt 74. The pressure port P is connected in communication to the working port A through the check valve seat 28 and the check valve chamber 29 in that order within the valve casing 27. A check valve member 30 inserted into the check valve chamber 29 is resiliently urged for valve closing to the check valve seat 28 by a checking spring 31.

The valve opening actuator means 15 is disposed outside (above, in FIG. 1) the pressure port P and the check valve seat 28 and is provided with a valve-opening hydraulic piston 33 inserted into the valve causing 27. Above the piston 33 there are provided a hydraulic actuation chamber 34 and pilot port F. By making the external dimension D of the piston 33 smaller than a cutoff diameter dimension E of the check valve seat 28 a piston pressure receiving cross-sectional area is set at a smaller value than a pressure non-receiving cross-sectional area within the check valve seat 28. A valve opening member 35 disposed below the piston 33 is located opposite the check valve member 30 relative to the location of the pressure port P. The valve seat surface of the check valve member 30 is made of a resilient material such as fluoroplastic and the like.

A bypass passage 16 is formed between the pressure port P to the working port A in parallel with the check valve seat 28 and the check valve chamber 29. The residual pressure holding valve 17 disposed in a midway portion of the bypass 16 is provided with a residual pressure holding valve member 38 inserted into an accommodation bore 75 of the hydraulic piston 33 and a residual pressure holding valve seat 40 formed in the check valve member 30. The valve member 38 is resiliently used for valve closing towards the valve seat 40 by means of the residual pressure holding spring 19 mounted in a spring accommodation bore 76. The resilient (bias) force of the spring 19 is set at a smaller value than the resilient force of the checking spring 31. The bore 76 is connected in communication with the check valve inlet 14*a* through a communication groove 38*a*. Also the valve surface of the valve member 38 is made of a resilient material such as fluoroplastic and the like. The flow restrictor means 21 disposed in the central portion of the bypass passage 16 is located between the pressure port P and the residual pressure holding valve 17 and comprises a throttling passage 44 composed of an annular clearance gap defined between the lid bolt 74 and the check valve member 30.

An annular filter chamber 78 is formed between the pressure port P and the residual pressure holding valve 17 as well as the check valve 14. An annular primary filter 79 is mounted in the filter chamber 78. Further, a secondary filter 94 is mounted between the residual pressure holding valve 17 and the working port A. This secondary filter 94 is urged towards the check valve member 30 by the checking spring 31.

The operation of the aforementioned valve device 11 will be explained with reference to FIG. 7.

Figure 7C:
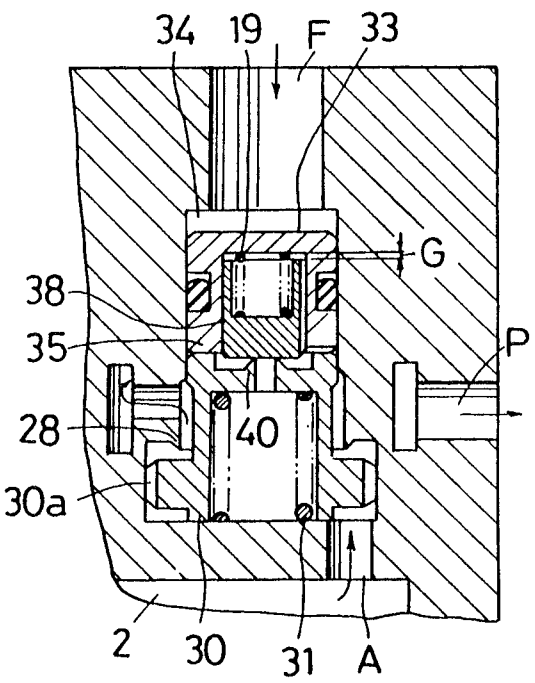
Figure 7B:
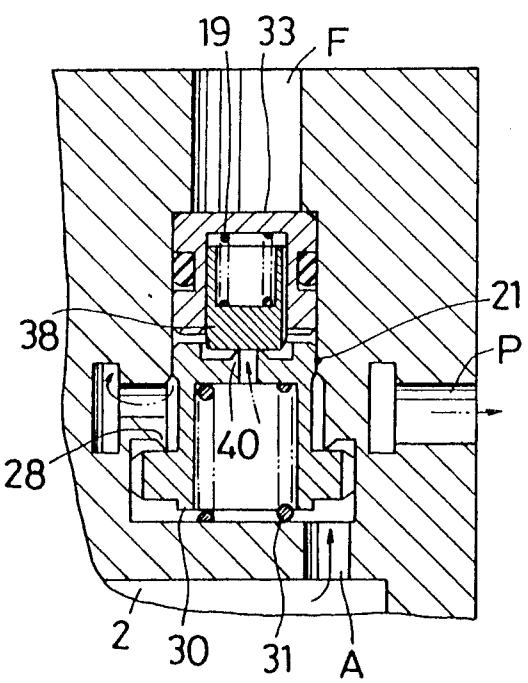
Figure 7A:
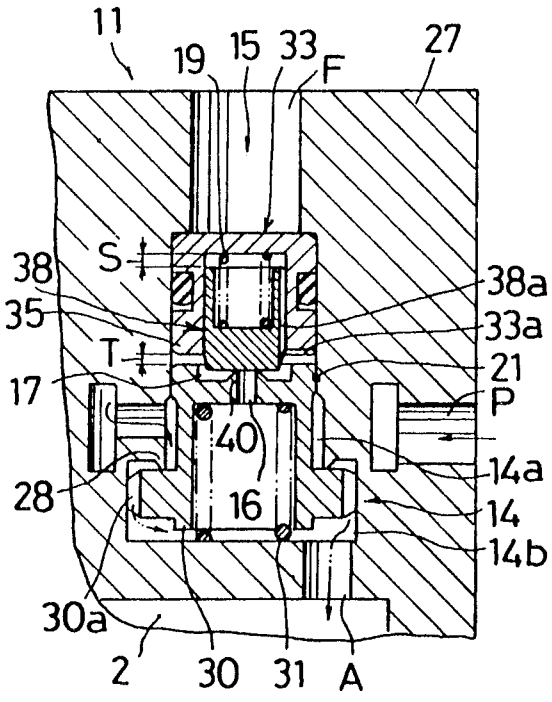

FIG. 7(*a*) shows the clamping condition. At the time of clamping operation, the pressurized oil supplied from the pressure port P serves to push and open the check valve member 30 and flows into the hydraulic actuation chamber 2 from its peripheral grooves 30*a* through the working port A. After the pressure within the chamber 2 has increased, the check valve member 30 is brought into contact with the check valve seat 28 for valve closing by the checking spring 31. The residual pressure holding valve member 38 is brought into contact with the residual pressure holding valve seat 40 for valve closing by the residual pressure holding spring 19. Further, a valve opening clearance S is formed between the valve member 38 and the valve-opening hydraulic piston 33, and an abutment clearance T is formed between the valve opening member 35 of the hydraulic piston 33 and the check valve member 30.

Under this clamping condition, when the pressure of the hydraulic actuation chamber 2 increases very slowly so that the pressure at the check valve outlet **14*b* is increased, the residual pressure holding valve member 38 is opened by that hydraulic pressure against a resultant force of the received pressure at the check valve inlet 14*a* and the resilient force of the residual pressure holding spring 19**, so that the very slowly increased portion of the hydraulic pressure is released from the pressure port P.

FIG. 7(*b*) shows the residual pressure holding condition, when the pressure within the pressure port P drops abnormally. Firstly, the residual pressure holding valve member 38 is opened by the received pressure from the check valve outlet **14*b* against the residual pressure holding spring 19 while the check valve member 30 is held in such a condition that it is kept in contact with the check valve seat 28 for valve closing. Thereby, the pressurized oil within the working port A is discharged slowly from the pressure port P through the check valve outlet 14*b*, the residual pressure holding valve seat 40 and the flow resistance application means 21 in that order as indicated by the arrow of the alternate long and two short dashes lines. When the pressure of the check valve inlet 14*a* lowers to a residual pressure set pressure L (refer to FIG. 3), the valve member 38 is brought into contact with the valve seat 40 for valve closing by the spring 19. As a result, the pressures at the working port A and at the hydraulic actuation chamber 2** are prevented from being lowered below the aforementioned pressure L.

FIG. 7(*c*) shows the unclamping condition. By supplying the pressure fluid from the pilot port F to the hydraulic actuation chamber 34, the valve-opening hydraulic piston 33 serves to separate the check valve member 30 from the check valve seat 28 through the valve opening member 35. Thereby, the oil within the hydraulic actuation chamber 2 is discharged frcm the pressure port P. In this case, an abutment preventing clearance G is provided between the residual pressure holding valve member 38 and the hydraulic piston 33. Thereby, the valve closing force between the residual pressure holding valve member 38 and the residual pressure holding valve seat 40 is provided only by the resilient force of the residual pressure holding spring 19. As a result, the valve surface of the valve member 38 can be prevented from being damaged, so that the service life thereof can be prolonged.

Figure 21:
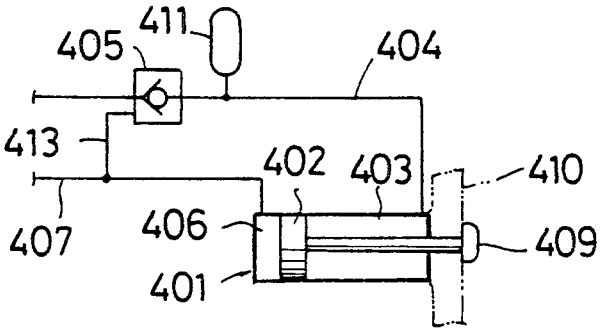
Fig. 21 PRIOR ART
FIG. 21 shows a conventional embodiment and is a partial view corresponding to FIG. 2.

Further, sinc the respective valve surfaces of the check valve member 30 and of the residual pressure holding valve member 38 are made of a resilient material, oil leakage can be prevented more surely. As a result, the accumulator 411 empolyed in the conventional embodiment (refer to FIG. 21) can be omitted, so that the entire valve device 11 can be made small. Incidentally, the sealing resilient member may be provided at the check valve seat 28 and at the residual pressure holding valve seat 40.

The residual pressure holding valve device 11 having the aforementioned construction may be used as shown in FIG. 4.

The pressure ports P of the respective valve devices 11 are selectively connected to the booster pump (the hydraulic pressure source) **6*a* the starting end portion of the working pressure oil supply passage 5 and to the oil tank 8 at the terminal portion of the return pressure oil discharge passage 7 through the pressurized oil supply/discharge passage 3 and the pressurized oil supply/-discharge changeover means 4. The booster pump 6 is adapted to operatively deliver an oil within the oil tank 8 when a compressed air is supplied thereto from a pneumatic source 80 through a pressure reduction valve 81. In the central portion of the pressuized oil supply/-discharge passage 3 there are provided two flexible hydraulic hoses 10, 10, and the pressure compensation valve 12 is disposed along both the passage 3 and the passage 7 in parallal with the changeover means 4**.

The pilot ports F of the respective valve devices 11 are selectively connected to a valve-opening pressure oil supply passage 84 and to a valve-opening cancellation pressure oil discharge passage 85 through the pressure oil supply/discharge passage 82 and the pressure oil supply/discharge changeover means 83. The changeover means 83 employs a hydraulic changeover valve having the same construction as that of the pressure oil supply/discharge changeover means 4. The pressure oil supply passage 84 is connected to the working pressure oil supply passage 5, and the pressure oil discharge passage 85 is connected to the return pressure oil discharge passage 7. Also in the central portion of the passage 82 there are interposed two flexible hoses 87, 87.

The aforementioned two changeover means 4, 83 are operatively changed over to the supply position M and to the discharge position N by means of an electromagnetic pneumatic changeover valve 89. When the pneumatic changeover valve 89 is changed over to the clamping position C, one changeover means 4 is changed over to the supply position M and the other changeover means 83 is changed over to the discharge position N. Thereby, the pressure oil of the booster pump 6 is supplied to the pressure port P of the valve device 11, so that four hydraulic clamps 54 are actuated for clamping. This clamping operational condition is detected by means of a pressure switch 91. When the pneumatic changeover valve 89 is changed over to the unclamping position U, however, the one changover means 4 is changed over to the discharge position N and the other changeover means 83 is changed over to the supply position M. Thereby, the pressure oil of the booster pump 6 is supplied to the pilot port F of the valve device 11. As a result, the pressurized oil within the hydraulic actuation chamber 2 is discharged from the pressure port P to the oil tank 8 through the changeover means 4, so that the respective hydraulic clamps 54 are actuated for unclamping. This unclamping operation condition is detected by means of a pressure switch 92.

Incidentally, the opening actuator means 15 may be of the pneumatic actuation type or of the manual operation type.

FIG. 8 through 11 show a first variat through a fourth variant of the first embodiment respectively. In the respective variants, component members having the same constructions as those in the aforementioned embodiment are generally designated by the same symbols.

Figure 8:
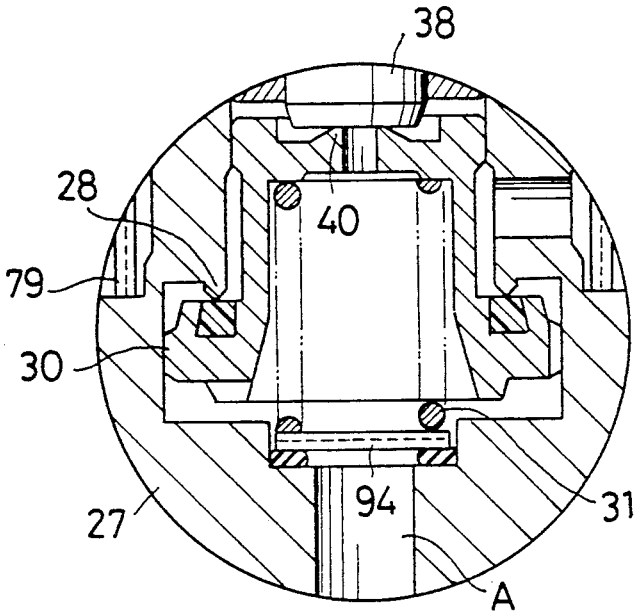

FIG. 8 shows a first variant and is a partial view corresponding to FIG. 1. To a portion facing the working port A within the valve casing 27, a secondary filter 94 is pressed and fixed oil-tightly by means of the resilient forces of the checking spring 31.

Figure 9:
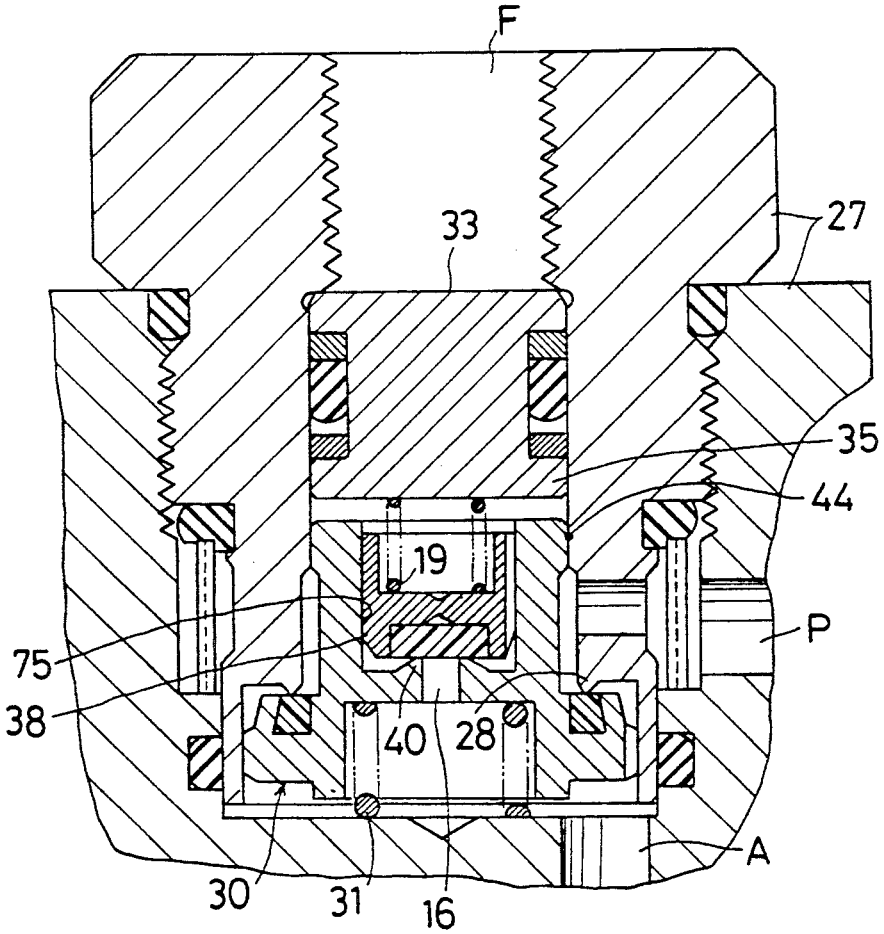

FIG. 9 shows a second variant and is a view corresponding to FIG. 1.

The residual pressure holding valve seat 40 is formed in the central portion of the check valve member 30, and the residual pressure holding valve member 38 is inserted into the check valve member 30.

Incidentally, the secondary filter 94 shown in FIG. 1 and FIG. 8 is omitted.

Figure 10:
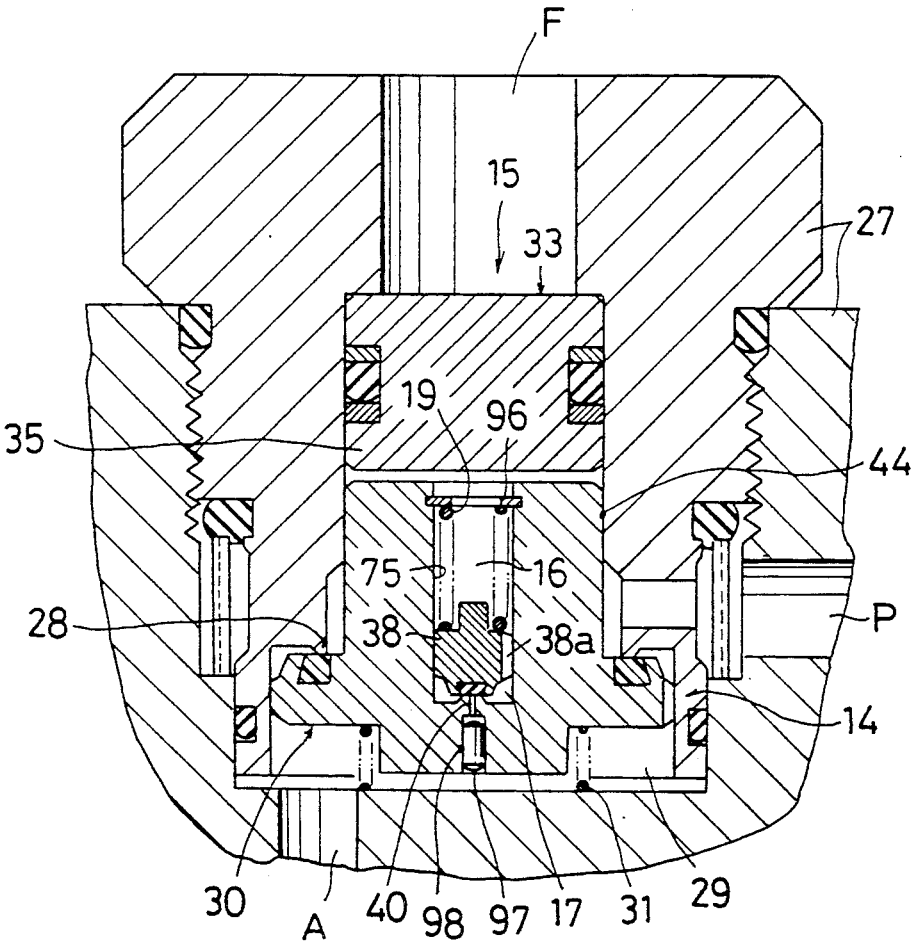

FIG. 10 shows a third variant which is different from the variant of the FIG. 9 in the following constructions.

The residual pressure holding spring 19 is received by a stop ring 96 fitted to the check valve member 30. The restrictor means disposed in the central portion of the bypass passage 16 is composed of a throttling passage 44 between the valve casing 27 and the check valve member 30 and a throttling passage 98 between the check valve member 30 and a throttling valve member 97.

Figure 11:
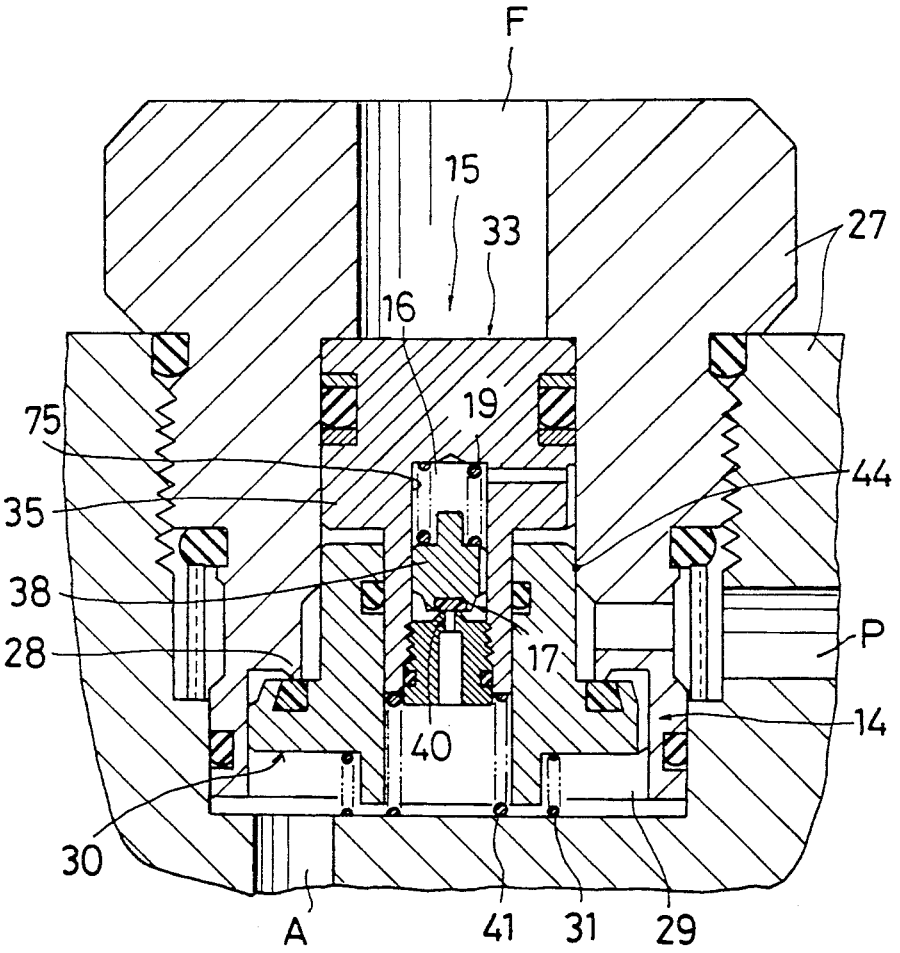

FIG. 11 shows a fourth variant and is a view corresponding to FIG. 1.

An project portion of the valve-opening hydraulic piston 33 is inserted oil-tightly and movably into the check valve member 30. The residual pressure holding valve seat 40 is formed in the projected portion, and the residual pressure holding valve member 38 is inserted therein.

Figure 13:
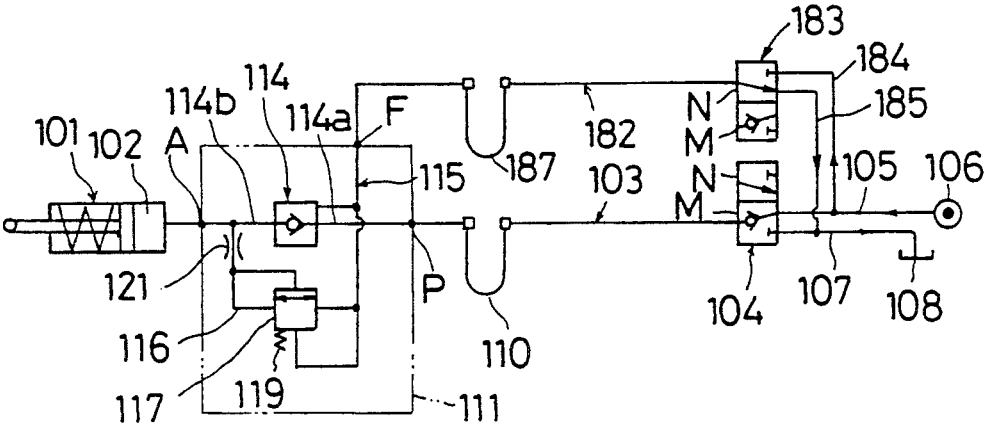
Figure 12:
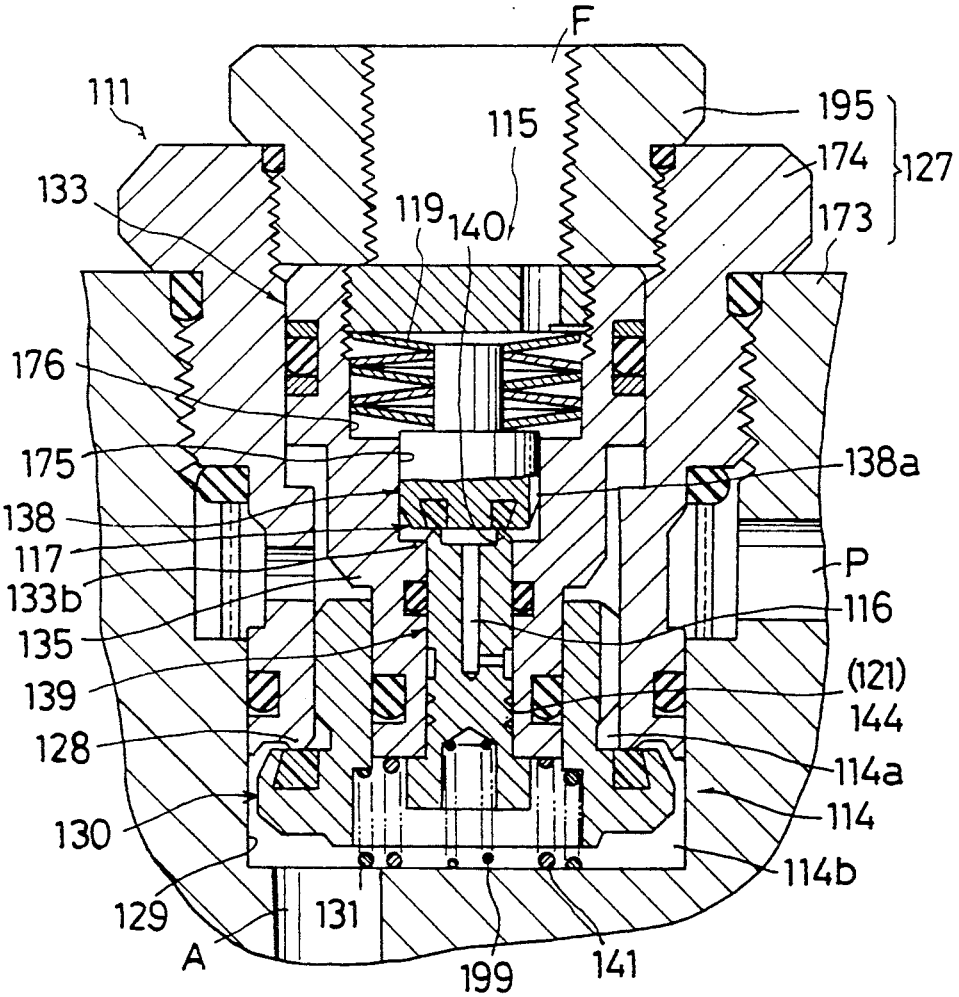
Figure 14:
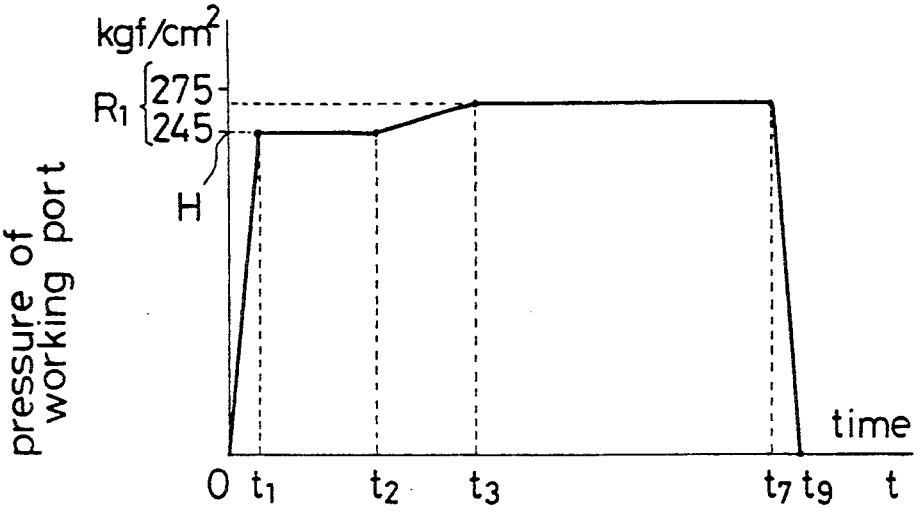

FIGS. 12 through 14 show a second embodiment of the invention. This second embodiment is different from the first embodiment in the following constructions. Incidentally, component members of this embodiment are designated by numerals obtained by adding the number 100 to numerals applied to the corresponding component members employed in the first embodiment described above.

As shown in the circuit diagram of FIG. 13, a check valve outlet **114*b* and a pressure oil supply/discharge passage 182 of a valve opening actuator means 115 are connected to each other by a relief passage 116. A flow restictor means 121 and a residual pressure holding valve 117 are disposed in (i.e., connected by) the relief passage 116 in series. The resilient force of the residual pressure holding spring 119, as shown in FIG. 14, is set at a larger value than the fluid force which residual pressure holding valve member 138 receives from check valve outlet 114*b* when the pressure of the working port A has reached a working set pressure H (herein, 245 kgf/cm$^2$) within the first pressure range $R_1$ (time $t_1$). The state between the time $t_2$ and the time $t_3$ in FIG. 14 shows that the pressure of the hydraulic actuation chamber 102 has increased very slowly to the point where pressure relief is required. This pressure relief operation is carried out against only the resilient force of the residual pressure holding spring 119, and the pressure compensation valve 12 in FIG. 2 is unnecessary. When the pressure of the pressure port P lowers abnormally during a clamping operation between the time $t_1$ and the time $t_7$, the residual pressure holding valve 117 is held in the valve closed condition by means of the strong resilient force of the residual pressure holding spring 119**, so that the pressure of the working port A is prevented from dropping below the working set pressure H.

A specific construction of the residual pressure holding valve device 111 is as follows.

As shown in FIG. 12, a valve-opening hydraulic piston 133 inserted into a lid bolt 174 has its external cross sectional diameter defined at a larger value than the cross sectional dimension of check valve seat 128. The piston 133 is adapted to be received by the stopper bolt 195 provided in the lid bolt 174. According to this construction, since actuating pressure on the piston 133 at the time of unclamping can be made large, it becomes possible to forcibly open a check valve member 130. The symbol 141 designates a return spring of the hydraulic piston 133.

The projected portion of the hydraulic piston 133 is oil-tightly and movably inserted into the check valve member 130. A residual pressure holding valve member accommodation bore 175 and a spring accommodation bore 176 are formed in a relief passage 116 comprising a through-hole of the hydraulic piston 133. A residual pressure holding valve member 138 and a residual pressure holding spring 119 composed of a plurality of conical disc springs are inserted into the respective bores 175, 176. A residual pressure holding valve seat 140 is disposed in the leading end portion of a valve seat tube 139 oil-tightly and movably inserted into the hydraulic piston 133 and is resiliently urged to the valve member 138 by means of a valve closing spring 199. A flow resistance application means 121 disposed in the central portion of the relief passage 116 is composed of an annular throttling passage 144 between the valve seat tube 139 and the hydraulic piston 133.

Incidentally, the respective valve surfaces of the check valve member 130 and the residual pressure holding valve member 138 are made of a resilient material such as fluoroplastic and the like.

Figure 15:
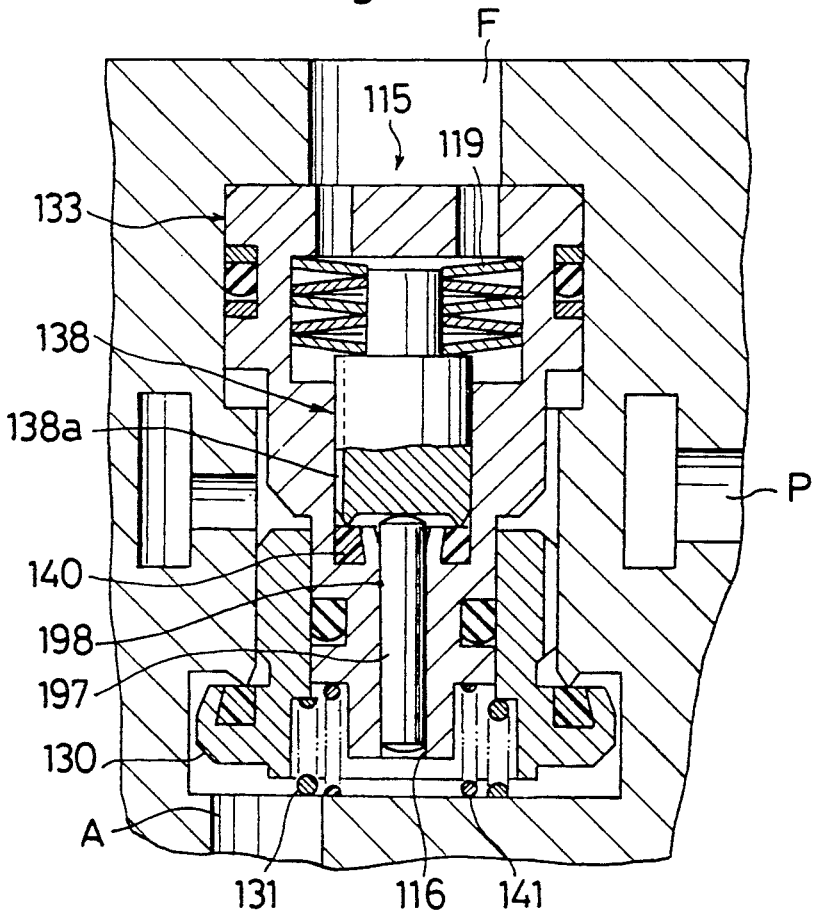

FIG. 15 shows a variant of the second embodiment, which is provided by modifying the one of FIG. 12 as follows.

The residual pressure holding valve seat 140 is fixedly secured to the valve-opening hydraulic piston 133 of the valve opening actuator means 115. The flow restrictor means of the relief passage 116 is composed of an annular throttling passage 198 between the projected portion of the hydraulic piston 133 and a throttling valve member 197 inserted into the projected portion.

Figure 17:
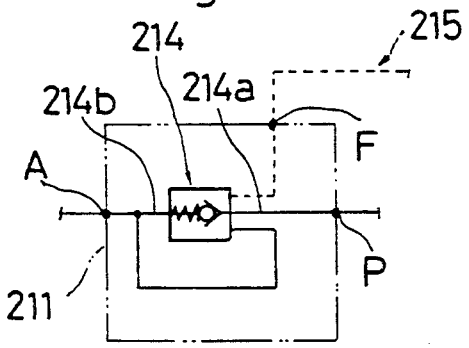
Figure 16:
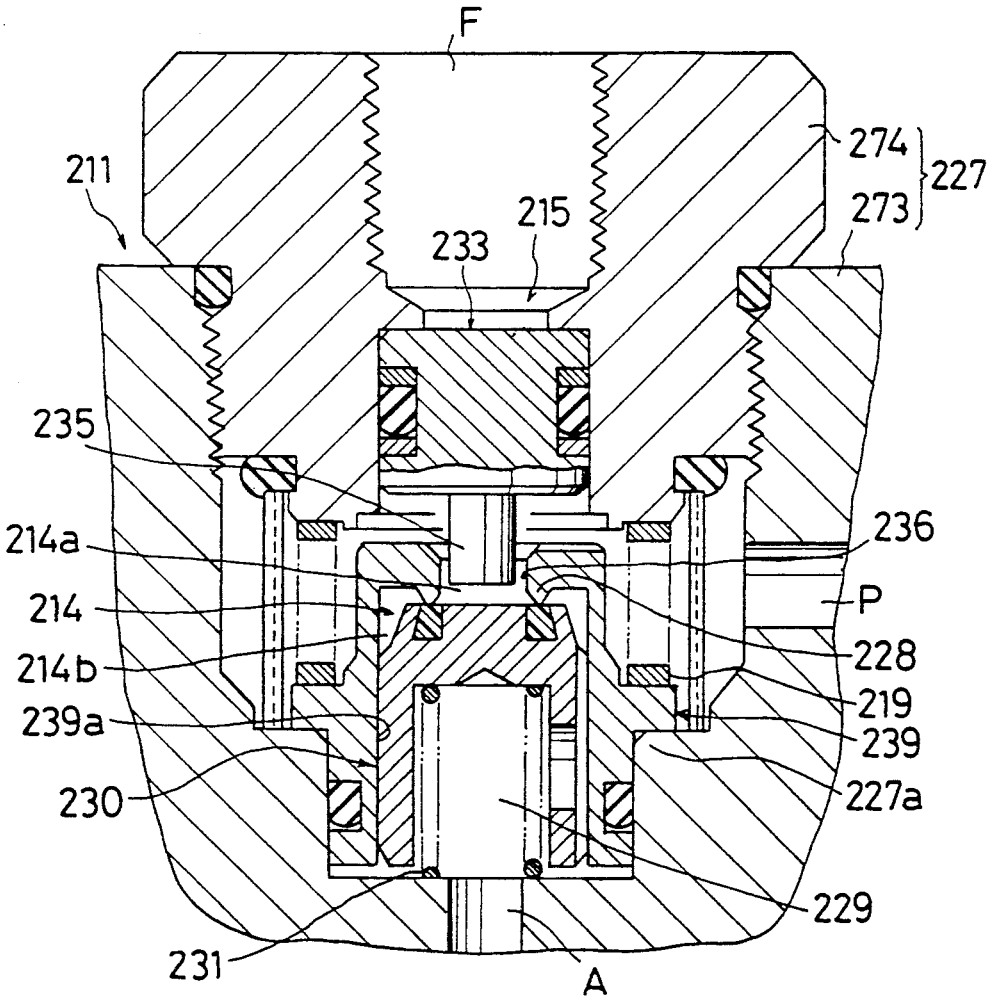
Figure 18:
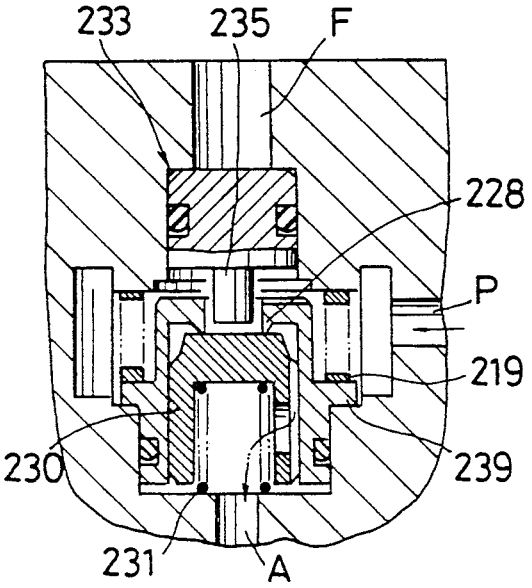
Figure 18B:
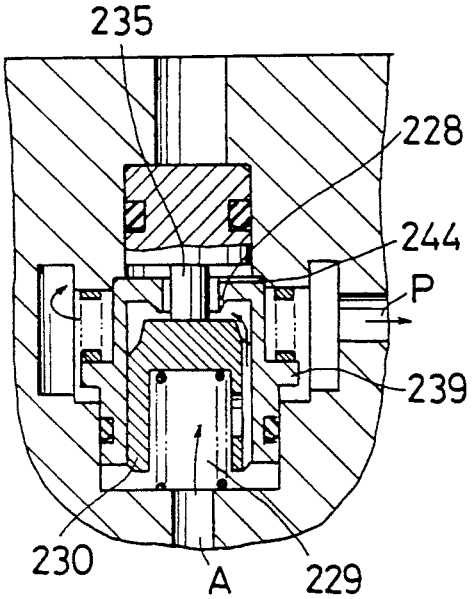
Figure 18C:
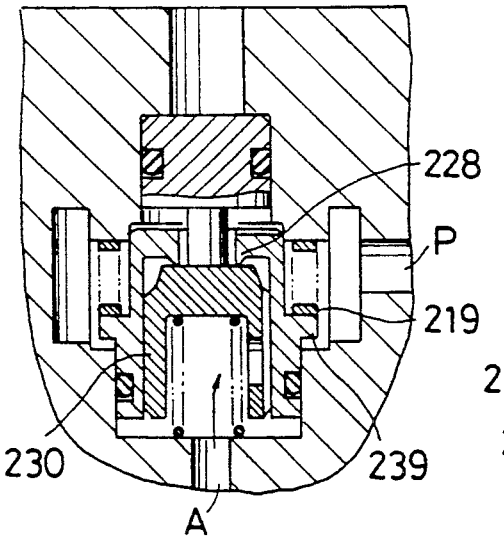
Figure 18D:
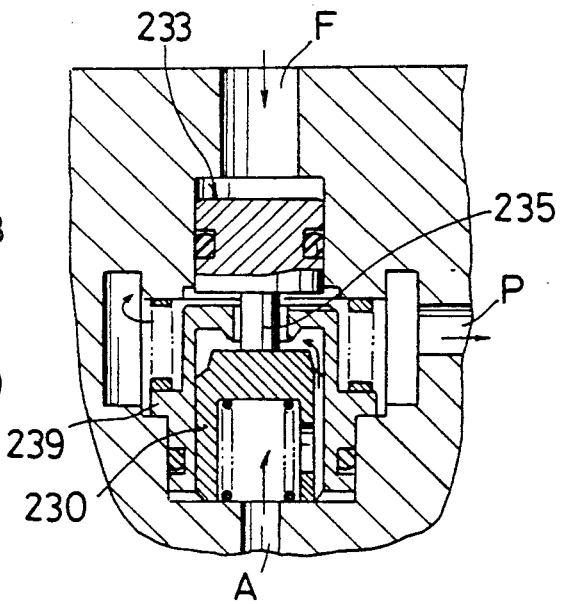

FIGS. 16 through 18 show a third embodiment. This third embodiment is different from the first embodiment in the following specifics. Incidentally, respective component members of this embodiment are designed by symbols obtained by adding 200 to those numbers of the corresponding component members of the first embodiment.

As shown in a cross-sectional view of FIG. 16 and in a circuit diagram of FIG. 17, a valve seat tube 239 is oil-tightly and movably inserted into a valve casing 227. An insertion port 236 for a valve opening member 235, a check valve seat 228 and a check valve chamber 229 within a cylindrical port **239*a* are provided in that order in the valve seat tube 239. A check valve member 230 inserted into the check valve chamber 229 is resiliently urged for valve closing to the check valve seat 228 by means of a checking spring 231, and the valve seat tube 239 is resiliently urged to the valve member 230 by means of a residual pressure holding spring 219. This valve seat tube 239 is prevented by a reduced-diameter stopper portion 227*a* of the valve casing 227 from moving towards the valve closing side farther than a predetermined distance. Incidentally, the valve surface of the check valve member 230** is made of a resilient material.

The residual pressure holding valve device 211 having the above-mentioned construction operates as illustrated in FIG. 18(*a–d*).

FIG. 18(*a*) shows a clamping condition. At the time of clamping operation, the pressurized oil at the pressure port P serves to separate the check valve member 230 from the check valve seat 228 so that oil flows into the hydraulic actuation chamber (herein, not illustrated) through the working port A. Subsequently, after the inner pressure of the hydraulic actuation chamber has increased, the check valve member 230 is brought into contact with the check valve seat 228 for valve closing by the checking spring 231. Under this clamping condition, when the pressure in the hydraulic actuation chamber increases very slowly and then this pressure reaches the working port A, the check valve member 230 in valve opening member 235 is prevented from moving towards valve closing while the valve seat tube 239 is moved to its valve opening side by the increased hydraulic pressure against the residual pressure holding spring 219. Thereupon, the check valve seat 228 is separated from the check valve member 230, so that the very slowly increased portion of the hydraulic pressure can be released from the pressure port P.

FIG. 18(*b*) shows an initial condition during the residual pressure holding operation. When the pressure of the pressure port P lowers abnormally under the clamping condition in FIG. 18(*a*), a differential pressure between the working port A and the pressure port P overcomes the resilient force of the residual pressure holding spring 219 so as to move the valve seat tube 239 to its valve opening side. Thereby, the pressure oil of the working port A is discharged slowly from the pressure port P through the check valve chamber 229, the check valve seat 228 and the throttling passage 244, in that order.

When the pressure at the working port A lowers, as shown in the residual pressure holding condition of FIG. 18(*c*), the valve seat tube 239 is moved to its valve closing side by the residual pressure holding spring 219 so as to bring the check valve seat 228 into contact with the check valve member 230 for valve closing. Thereby, the pressure at the working port A is prevented from lowering below that pressure.

FIG. 18(*d*) shows an unclamping condition. By supplying the pressure oil from the pilot port F, the valve-opening hydraulic piston 233 serves to separate the check valve member 230 from the check valve seat 228 through the valve opening member 235. Thereby, the pressure oil of the hydraulic actuation chamber is discharged from the working port A to the pressure port P.

Incidentally, the valve opening actuator means 215 may be of the pneumatic actuation type or the manual operation type instead of the hydraulic actuation type.

Figure 19:
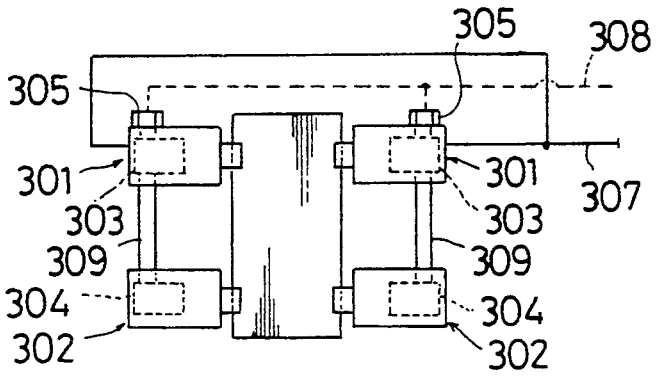

FIG. 19 shows a fourth embodiment.

One pair of hydraulic clamps 301, 301 of two pairs of hydraulic clamps have hydraulic actuation chambers 303 to which residual pressure holding valve devices 305 are fixedly secured. A clamping and unclamping pressurized oil supply/discharge passage 307 and a valve-opening and valve-opening cancellation oil supply/discharge passage 308 are connected to each valve device 305. Each hydraulic actuation chamber 304 of the other hydraulic clamps 302, 302 is connected to the one hydraulic actuation chamber 303 through a communication pipe 309.

Figure 20:
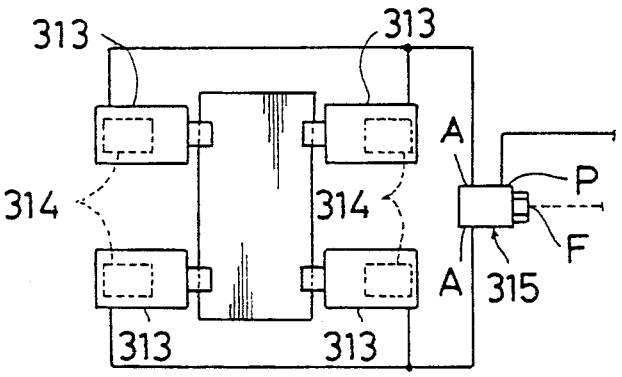

FIG. 20 shows a fifth embodiment.

Each hydraulic actuation chamber 314 of four hydraulic actuation clamps 313 is connected to one residual pressure holding valve device 315. This valve device 315 is provided with one pressure port P, one pilot port F and two working ports A.

Incidentally, the present invention may be modified as follows besides the above-mentioned embodiments and variants.

(a) The hydraulic clamp is not limited to one wherein the clamping member is actuated in the inclined direction but may be used for other kinds of working or processing machines such as a press machine and the like.

(b) The hydraulic cylinder may be of the double acting type instead of the single acting type.

(c) Since it is enough that the pressure compensation valve 12 is such a one as to release the very slowly increased portion of the hydraulic pressure caused by the volumetric expansion of the trapped working oil, the valve 12 may be of another type instead of an assembly of the throttling valve and the relief valve.

As many different embodiments of the invention will be obvious to those skilled in the art, some of which have been disclosed or referred to herein, it is to be understood that the specific embodiments of the present invention as presented herein are intended to be by way of illustration only and not to limit the invention, and it is to be understood that such embodiments, variants, or modifications may be made without departing from the spirit and scope of the invention as set forth in the claims appended hereto.

What is claimed is:

1. A pressurized oil supply/discharge circuit including a hydraulic actuation chamber (2) in a hydraulic cylinder (1) adapted to be selectively connected to a working pressure oil supply passage (5) and to a return pressure oil discharge passage (7) through a pressure oil supply/discharge passage (3) and a pressure oil supply/discharge changeover means (4), said circuit comprising:

a check valve (14) disposed in said pressurized oil supply/discharge passage (3), said valve (14) including an inlet (14*a*) adapted to be connected to said changeover means (4) and an outlet (14*b*) adapted to be connected to said actuation chamber (2);

a valve opening actuator means (15) for forcibly opening said check valve (14) so as to allow a counter flow of oil from the outlet (14*b*) to the inlet (14*a*);

a bypass passage (16) connected to said supply/discharge passage (3) in parallel with said check valve (14);

a relief type residual pressure holding valve (17) and a flow restrictor means (21) disposed in said bypass passage (16) in series;

said residual pressure holding valve (17) having a residual pressure holding spring (19) biasing said pressure holding valve towards a closed position, and opening of said valve (17) being effected by means of a differential force developed, on the one hand, between a received pressure at said check valve outlet (14*b*) and, on the other hand, a resultant force of a received pressure at said check valve inlet (14*a*) and the resilient force of said spring (19); and a pressure compensation valve (12) disposed in said supply/discharge passage (3) and said discharge passage (7) in parallel with said supply/discharge changeover means (4) arranged so as to discharge only a very slowly increased portion of the hydraulic pressure trapped within said hydraulic actuation chamber (2).

2. A pressurized oil supply/discharge circuit as defined in claim 1, wherein the resilient force of said residual pressure holding spring (19) is set at a smaller value than the fluid force which the valve member (38) of said residual pressure holding valve (17) receives from the check valve outlet (14*b*) when the pressure of said check valve outlet (14*b*) has reached a working set pressure (H).

3. A residual pressure holding valve device including a pressure port (P) connected in communication with a working port (A) through a check valve seat (28) and a check valve chamber (29) in that order and a check valve member (30) within said check valve chamber (29) in a valve casing (27), said valve member (30) having a valve face resiliently urged in a valve closing direction towards said check valve seat (28) by means of a checking spring (31), said pressure port (P) located to one side of said check valve member (30), said device comprising:

a valve opening actuator means (15) including a valve opening member (35) located on the opposite side of said pressure port P from the side of said port on which said check valve member (30) is located;

a bypass passage (16) extending from said working port (A) to said pressure port (P), in parallel with said check valve seat (28) and said check valve chamber (29);

a relief type residual pressure holding valve (17) and a flow restrictor means (21) having a throttling passage (44) disposed in said bypass passage (16) in series;

said residual pressure holding valve (17) comprising a residual pressure holding valve member (38) having a valve face resiliently urged towards a valve closing direction against a residual pressure holding valve seat (40) by means of the resilient force of a residual pressure holding spring (19);

the resilient force of said residual pressure holding spring (19) being set at a smaller value than the fluid force which the valve member (38) receives from the check valve outlet (14*b*) when the pressure of said working port (A) has reached a working set pressure (H); and opening of said valve member (38) being effected by means of the differential force developed between, on the one hand, a received oil pressure at said check valve outlet (14*b*) and, on the other hand, a resultant force of a received oil pressure at said check valve inlet (14*a*) and the resilient force of said residual pressure holding spring (19).

4. A valve device as defined in claim 3, wherein one of the valve face of said check valve member (30) and said check valve seat (28) is made of a resilient material, and the other thereof is made of a solid material, and one of the valve face of said residual pressure holding valve member (38) and said residual pressure holding valve seat (40) is made of a resilient material, and the other thereof is made of a solid material.

5. A valve device as defined in claim 4, wherein said residual pressure holding valve seat (40) is disposed in said check valve member (30), and said residual pressure holding spring (19) is disposed within a valve-opening hydraulic piston (33) of said valve opening actuator means (15); and the resilient force of said residual pressure holding spring (19) is set at a smaller value than that of said checking spring (31).

6. A valve device as defined in claim 5, wherein a contact clearance (T) is provided between said valve opening member (35) and said check valve member (30);

said residual pressure holding valve member (38) is disposed in said valve-opening hydraulic piston (33), and a valve opening clearance (S) is provided therebetween for said residual pressure holding valve member (38) that is greater than the contact clearance (T).

7. A valve device as defined in claim 3 including a cylinder body (1*a*).

said valve casing (27) is fixedly secured to said cylinder body (1*a*).

* * * * *